US007070461B1

(12) United States Patent
Pavlovic et al.

(10) Patent No.: US 7,070,461 B1
(45) Date of Patent: Jul. 4, 2006

(54) ELECTRICAL TERMINAL HAVING A TERMINAL BODY WITH ONE OR MORE INTEGRAL PROJECTIONS

(75) Inventors: Slobadan Pavlovic, Clawson, MI (US); David S. Menzies, Clawson, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 10/908,562

(22) Filed: May 17, 2005

(51) Int. Cl.
*H01R 4/38* (2006.01)

(52) U.S. Cl. ..... 439/766; 439/801; 439/883

(58) Field of Classification Search ..... 439/756–758, 439/927, 766–768, 777, 522, 755, 436, 801, 439/805, 883–884; 411/134
See application file for complete search history.

(56) References Cited

U.S. PATENT DOCUMENTS

| | | | | |
|---|---|---|---|---|
| 1,874,593 | A * | 8/1932 | Olson | 439/883 |
| 2,541,096 | A * | 2/1951 | Ougljesa | 411/134 |
| 2,631,633 | A * | 3/1953 | Peckham | 411/134 |
| 3,190,333 | A * | 6/1965 | Lanius, Jr. | 411/134 |
| 3,258,048 | A * | 6/1966 | Schmidt | 411/134 |
| 3,540,509 | A * | 11/1970 | Gutshall | 411/145 |
| 4,157,725 | A * | 6/1979 | Stanaitis | 411/147 |
| 5,842,894 | A * | 12/1998 | Mehlberg | 439/801 |
| 6,613,263 | B1 | 9/2003 | Kondo | |
| 6,783,377 | B1 | 8/2004 | Aoyama | |
| 2001/0003688 | A1 | 6/2001 | Kondo | |
| 2002/0127915 | A1 | 9/2002 | Kondo | |
| 2004/0253871 | A1 | 12/2004 | Sakatani | |
| 2005/0136750 | A1 * | 6/2005 | Tournier et al. | 439/801 |

* cited by examiner

*Primary Examiner*—Hae Moon Hyeon
(74) *Attorney, Agent, or Firm*—Brooks Kushman P.C.

(57) ABSTRACT

An electrical terminal for connecting a conductor to a component includes a terminal body that is configured to be electrically connected to the conductor. The terminal body includes a first portion and at least one projection extending from the first portion. The terminal also includes a fastener associated with the terminal body for connecting the terminal body to the component. Furthermore, the at least one projection is engageable with the component and is configured to remove nonconductive coatings from the component as the terminal body is being connected to the component.

20 Claims, 1 Drawing Sheet

ELECTRICAL TERMINAL HAVING A TERMINAL BODY WITH ONE OR MORE INTEGRAL PROJECTIONS

BACKGROUND OF THE INVENTION

1. Field of the Invention

The invention relates to an electrical terminal and to an assembly including an electrical terminal.

2. Background Art

A prior electrical terminal includes a terminal body having a crimp connector that is configured to be connected to an electrical wire. The terminal further includes a nut that is rotatably connected to the terminal body for mounting the terminal on a threaded stud, which extends from a mounting surface. A separate lock washer may also be positioned between the terminal body and the mounting surface for inhibiting loosening of the nut. Furthermore, an integral plastic washer may be formed on a surface of the nut disposed away from the terminal body for inhibiting loosening of the nut.

SUMMARY OF THE INVENTION

Under the invention, an electrical terminal for connecting a conductor to a component is provided. In one embodiment, the terminal includes a terminal body that is configured to be electrically connected to the conductor. The terminal body includes a first portion and at least one projection extending from the first portion. The terminal also includes a fastener associated with the terminal body for connecting the terminal body to the component. Furthermore, the at least one projection is engageable with the component and is configured to remove nonconductive coatings from the component as the terminal body is being connected to the component.

In another embodiment, the terminal includes a terminal body that is configured to be electrically connected to the conductor. The terminal body includes a first portion and at least one projection extending from the first portion. The terminal also includes a fastener associated with the terminal body and being engageable with an attachment feature of the component for connecting the terminal body to the component. Moreover, the at least one projection is engageable with a contact surface of the component and is configured to urge the first portion of the terminal body away from the contact surface, when the terminal body is connected to the component, to inhibit loosening of the fastener from the attachment feature.

Further under the invention, an electrical assembly that is attachable to a component having an attachment feature and a contact surface is provided. The assembly includes an electrical conductor and an electrical terminal including a terminal body connected to the conductor. The terminal body has a main portion and multiple projections extending from the main portion. Each projection includes a cantilevered tooth member. The terminal further includes a fastener connected to the terminal body such that the fastener is rotatable with respect to the terminal body. The fastener is engageable with the attachment feature of the component and is configured to rotate in a first direction for attaching the terminal body to the component. The projections are engageable with the contact surface of the component and are configured to remove nonconductive coatings from the contact surface as the fastener is rotated in the first direction. The projections are also configured to urge the main portion of the terminal body away from the contact surface when the terminal body is connected to the component to inhibit the fastener from rotating in a second direction opposite the first direction.

While exemplary embodiments in accordance with the invention are illustrated and disclosed, such disclosure should not be construed to limit the claims. It is anticipated that various modifications and alternative designs may be made without departing from the scope of the invention.

DETAILED DESCRIPTION

Figure 2:
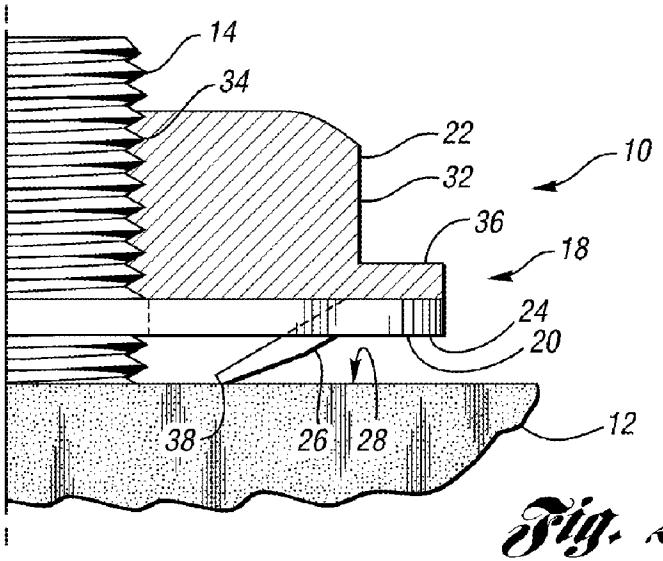
FIG. 2 is a fragmentary cross-sectional view of the assembly positioned on a mounting stud of a vehicle battery, wherein a projection of the terminal is shown in an extended position.
Figure 3:
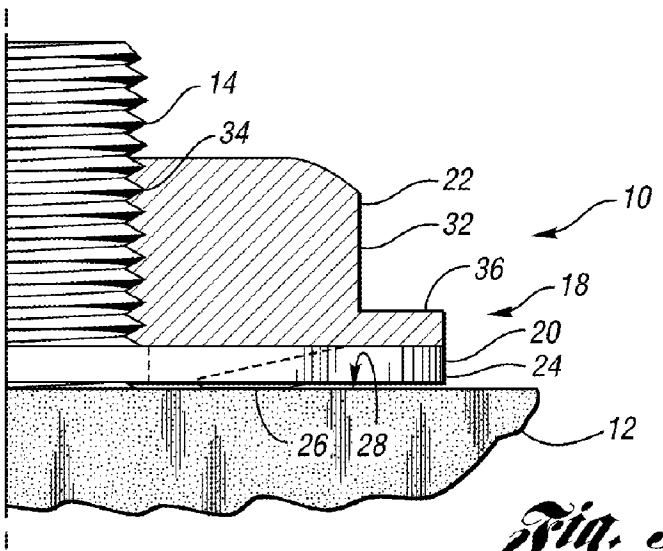
FIG. 3 is a fragmentary cross-sectional view similar to FIG. 2, wherein the projection is shown in a retracted position.
Figure 1:
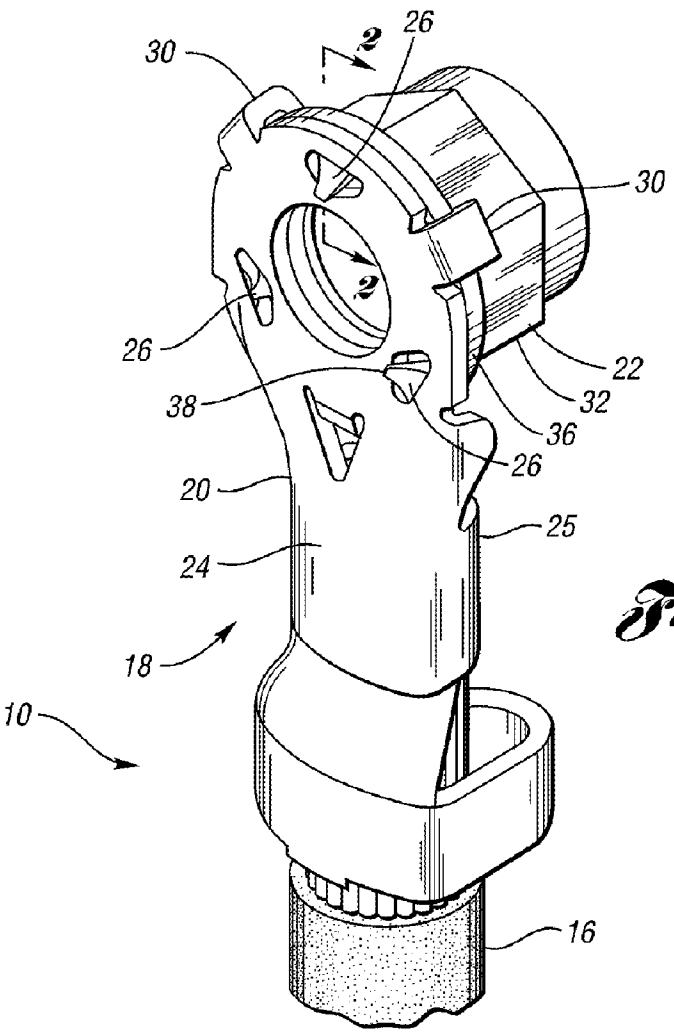
FIG. 1 is a perspective view of an electrical assembly according to the invention, wherein the assembly includes an electrical conductor connected to an electrical terminal.

FIGS. 1–3 show an electrical assembly 10 according to the invention. The assembly 10 is attachable to any suitable component such that the assembly 10 may be electrically connected to the component. For example, the assembly 10 may be attached to a vehicle battery 12 having a mounting stud 14, or other suitable mounting member. Other examples of components to which the assembly 10 may be connected include starters, alternators, grounding studs, vehicle bodies, etc.

The assembly 10 includes an electrical conductor 16, such as one or more insulated wires, and an electrical terminal 18 connected to the conductor 16. The terminal 18 includes a terminal body 20 and a fastener 22 associated with the terminal body 20.

While the terminal body 20 may be connected to the conductor 16 in any suitable manner, in one embodiment, the terminal body 20 includes a first portion, such as main portion 24, and a deformable connector portion 25 for connecting the conductor 16 to the main portion 24. The connector portion 25 may be crimped, for example, to secure the conductor 16 to the main portion 24.

In the embodiment shown in FIGS. 1–3, the terminal body 20 also includes one or more projections 26 extending from the main portion 24. While each projection 26 may have any suitable configuration for engagement with a contact surface or mounting surface 28 of the battery 12, in the embodiment shown in FIGS. 1–3, each projection 26 is formed as a cantilevered tooth member. As another example, each projection 26 may be formed as a coiled member having a sharp edge that is engageable with the mounting surface 28.

The terminal body 20 may also include one or more attachment members 30 for attaching the fastener 22 to the terminal body 20. For example, each attachment member 30 may be formed as a latch member that is engageable with a portion of the fastener 22.

While the terminal body 20 may be made of any suitable material and in any suitable manner, in one embodiment of the invention, the terminal body 20 is stamped from sheet metal, such as spring steel. As another example, the terminal body 20 may be formed of any suitable conductive material.

The fastener 22 may have any suitable configuration for attaching the terminal body 20 to the battery 12 or other component. For example, the fastener 22 may include a threaded portion, such as a nut 32, that is engageable with a threaded portion 34 of the stud 14 of battery 12. The fastener 22 may also include an attachment portion, such as a washer 36, that is engageable with the attachment members 30 such that the fastener 22 may be attached to the terminal body 20. Furthermore, the washer 36 may be integrally formed with, or otherwise fixedly attached to, the nut 32. For example, the nut 32 and washer 36 may be integrally formed from metal.

With the above configuration, the fastener 22 may be rotated with respect to the terminal body 20 to attach the terminal body 20 and conductor 16 to the battery 12. More specifically, the nut 32 may be rotated in a first direction to attach the entire assembly 10 to the battery 12.

As the nut 32 is rotated in the first direction about the stud 14, the projections 26 of the terminal 18 engage the mounting surface 28 of the component 12 and may remove nonconductive coatings from the mounting surface 28. For example, each projection 26 may be moveable from a first or extended position, shown in FIG. 2, to a second or retracted position, shown in FIG. 3, as the nut 32 is rotated in the first direction. With such a configuration, as the main portion 24 of the terminal body 20 moves closer to the mounting surface 28, the projections 26 may flatten out, thereby causing ends 38 of the projections 26 to wipe or scrape the mounting surface 28.

Because the projections 26 may remove non-conductive coatings from the mounting surface 28, electrical connection between the assembly 10 and the battery 12, or other suitable component, may be improved compared to prior electrical terminals. Furthermore, although the main portion 24 of the terminal body 20 is shown spaced away from the mounting surface 28 in FIG. 3, the main portion 24 may also be in contact with the mounting surface 28 when the assembly 10 is fully mounted on the mounting surface 28.

Alternatively or supplementally, the projections 26 may be configured to urge the main portion 24 of the terminal body 20 away from the mounting surface 28 when the terminal body 20 is connected to the battery 12, or other suitable component, to inhibit the fastener 22 from rotating in a second direction opposite the first direction. For example, each projection 26 may function as a spring member that urges the main portion 24 of the terminal body 20 against the washer 36 of the fastener 22. As a result, the projections 26 may inhibit loosening of the fastener 22 when the assembly 10 is connected to the battery 12. Furthermore, when the assembly 10 is removed from the battery 12, the projections 26 may each return to the extended position shown in FIG. 2.

In an embodiment of the assembly 10 that is configured for attachment to a grounding stud, such as a grounding stud attached to a vehicle body of a motor vehicle, the grounding stud may define the mounting surface. As another example, the vehicle body may define the mounting surface.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention. For example, a terminal according to the invention may include a push-type fastener that is mountable on any suitable mounting member, such as a mounting stud, of a component to thereby mount a terminal body of the terminal to the component. Furthermore, sufficient mounting force may be applied manually or with the assistance of a tool, such that projections of the terminal body may contact a mounting surface of the component.

What is claimed is:

1. An electrical terminal for connecting a conductor to a component, the terminal comprising:

a unitary terminal body having a first portion, a connector portion integrally formed with the first portion, and at least one projection integrally formed with the first portion and extending from the first portion, the connector portion being configured to be electrically connected to the conductor; and a fastener associated with the terminal body for connecting the terminal body to the component;

wherein the at least one projection is engageable with the component and is configured to remove nonconductive coatings from the component as the terminal body is being connected to the component.

2. The terminal of claim 1 wherein the fastener is connected to the terminal body such that the fastener is rotatable with respect to the terminal body.

3. The terminal of claim 2 wherein the fastener comprises a threaded portion.

4. The terminal of claim 1 wherein the at least one projection is configured to urge the first portion of the terminal body away from the component, when the terminal body is connected to the component, to inhibit loosening of the fastener.

5. The terminal of claim 1 wherein the fastener is connected to the terminal body such that the fastener is rotatable with respect to the terminal body, the fastener being configured to rotate in a first direction for attaching the terminal body to the component, and wherein the at least one projection is configured to urge the first portion of the terminal body away from the component, when the terminal body is connected to the component, to inhibit the fastener from rotating in a second direction opposite the first direction.

6. The terminal of claim 1 wherein the at least one projection includes multiple projections that each comprise a cantilevered tooth member.

7. The terminal of claim 1 wherein the at least one projection is moveable with respect to the first portion of the terminal body from an extended position toward a retracted position as the terminal body is being connected to the component.

8. The terminal of claim 7 wherein the at least one projection has an end that is configured to move across a mounting surface of the component as the terminal body is being connected to the component.

9. An electrical assembly that is attachable to a component having an attachment feature and a contact surface, the assembly comprising:

an electrical conductor; and an electrical terminal including a unitary terminal body having a main portion, a connector portion integrally formed with the main portion and connected to the conductor, and multiple projections integrally formed with the main portion and extending from the main portion, each projection including a cantilevered tooth member, the terminal further including a fastener connected to the terminal body such that the fastener is rotatable with respect to the terminal body, the fastener being engageable with the attachment feature of the component and being configured to rotate in a first direction for attaching the terminal body to the component, wherein the projections are engageable with the contact surface of the component and are configured to remove nonconductive coatings from the contact surface as the fastener is rotated in the first direction, the projections also being configured to urge the main portion of the terminal body away from the contact surface when the terminal body is connected to the component to inhibit the fastener from rotating in a second direction opposite the first direction.

10. The assembly of claim 9 wherein each projection is moveable with respect to the main portion of the terminal body from an extended position toward a retracted position as the terminal body is being attached to the component.

11. The assembly of claim 10 wherein each projection has an end that is configured to scrape laterally across a mounting surface of the component as the terminal body is being attached to the component, and wherein each projection is moveable toward a respective extended position when the terminal body is removed from the component.

12. An electrical terminal for connecting a conductor to a component having an attachment feature and a contact surface, the terminal comprising:

a unitary terminal body having a first portion, a connector portion integrally formed with the first portion, and at least one projection integrally formed with the first portion and extending from the first portion, the connector portion being configured to be electrically connected to the conductor; and a fastener associated with the terminal body and being engageable with the attachment feature of the component for connecting the terminal body to the component;

wherein the at least one projection is engageable with the contact surface of the component and is configured to urge the first portion of the terminal body away from the contact surface, when the terminal body is connected to the component, to inhibit loosening of the fastener from the attachment feature.

13. The terminal of claim 12 wherein the fastener is connected to the terminal body such that the fastener is rotatable with respect to the terminal body.

14. The terminal of claim 13 wherein the fastener comprises a threaded portion.

15. The terminal of claim 12 wherein the at least one projection is configured to remove nonconductive coatings from the contact surface of the component as the terminal body is being connected to the component.

16. The terminal of claim 12 wherein the fastener is connected to the terminal body such that the fastener is rotatable with respect to the terminal body, the fastener being configured to rotate in a first direction for attaching the terminal body to the component, and wherein the at least one projection is configured to urge the first portion of the terminal body away from the component, when the terminal body is connected to the component, to inhibit the fastener from rotating in a second direction opposite the first direction.

17. The terminal of claim 12 wherein the at least one projection includes multiple projections that each comprise a cantilevered tooth member.

18. The terminal of claim 12 wherein the at least one projection comprise a cantilevered tooth member.

19. The terminal of claim 12 wherein the at least one projection is moveable with respect to the first portion of the terminal body from an extended position toward a retracted position as the terminal body is being connected to the component.

20. The terminal of claim 19 wherein the at least one projection has an end that is configured to move across a mounting surface of the component as the terminal body is being connected to the component.

* * * * *